US011236512B2

(12) United States Patent
Williams et al.

(10) Patent No.: US 11,236,512 B2
(45) Date of Patent: Feb. 1, 2022

(54) ROTATABLE STRUCTURAL BRACKET

(71) Applicant: City Post and Rail, LLC, Liberty Lake, WA (US)

(72) Inventors: Nathan A. Williams, Spokane, WA (US); Michael M. Mosback, Liberty Lake, WA (US)

(73) Assignee: CityPost LLC, Liberty Lake, WA (US)

( * ) Notice: Subject to any disclaimer, the term of this patent is extended or adjusted under 35 U.S.C. 154(b) by 178 days.

(21) Appl. No.: 16/203,332

(22) Filed: Nov. 28, 2018

(65) Prior Publication Data

US 2019/0186154 A1 Jun. 20, 2019

Related U.S. Application Data

(60) Provisional application No. 62/607,172, filed on Dec. 18, 2017.

(51) Int. Cl.
*E04F 11/18* (2006.01)

(52) U.S. Cl.
CPC ..... *E04F 11/1834* (2013.01); *E04F 11/1859* (2013.01); *E04F 2011/1819* (2013.01); *E04F 2011/1821* (2013.01); *E04F 2011/1831* (2013.01)

(58) Field of Classification Search
CPC ..... E04F 11/1834; E04F 11/1859; E04F 2011/1819; E04F 2011/1821; E04F 2011/1831; E04H 2017/1491; F16B 9/052; F16B 9/058; F16C 11/10; F16C 11/103; Y10T 403/32254; Y10T 403/32271; Y10T 403/46; Y10T 403/7041
USPC ..... 256/65.07, 67; 403/83, 84, 230, 362
See application file for complete search history.

(56) References Cited

U.S. PATENT DOCUMENTS

| | | | | |
|---|---|---|---|---|
| 4,928,930 | A * | 5/1990 | Chung | E04F 11/1834 256/67 |
| 5,437,433 | A * | 8/1995 | Rezek | E04F 11/1834 256/67 |
| 5,873,671 | A * | 2/1999 | West | E04F 11/1834 256/65.05 |
| 7,681,866 | B2 * | 3/2010 | Lehmann | E04F 11/1834 256/67 |
| 9,169,651 | B1 * | 10/2015 | Wynne | E04F 11/1834 |
| 10,450,758 | B2 * | 10/2019 | Burt | E04F 11/1834 |
| 10,689,857 | B2 * | 6/2020 | Van Lennep | E04F 11/1812 |
| 10,947,738 | B2 * | 3/2021 | Loh | E04F 11/1834 |

(Continued)

FOREIGN PATENT DOCUMENTS

EP 1526229 A1 * 4/2005 ..... E04H 17/1434

*Primary Examiner* — Josh Skroupa
(74) *Attorney, Agent, or Firm* — FIG. 1 Patents

(57) ABSTRACT

A rotatable structural bracket includes a top plate for placement in a horizontal rest position on an end of a structural section that has an internal void. The rotatable structural bracket also includes a rotatable extension for placement into the internal void of the structural section. The rotatable extension can be configured as a wedge that is rotatable out from the internal void to angle the top plate at any acute angle relative to the horizontal rest position of the top plate. The top plate and the rotatable extension are of single-piece construction, and the rotatable extension rotates relative to the structural section and internal of the structural section. The rotatable extension also encompasses an opening of the internal void at any acute angle.

20 Claims, 5 Drawing Sheets

(56) References Cited

U.S. PATENT DOCUMENTS

| | | | | |
|---|---|---|---|---|
| 2009/0200532 | A1* | 8/2009 | Platt | E04F 11/1834<br>256/67 |
| 2016/0024800 | A1* | 1/2016 | Gratrix | F16B 9/052<br>248/514 |
| 2018/0223538 | A1* | 8/2018 | Loh | E04F 11/1834 |

* cited by examiner

ROTATABLE STRUCTURAL BRACKET

RELATED APPLICATION

This application claims priority to U.S. Provisional Patent Application Ser. No. 62/607,172 filed Dec. 18, 2017 entitled "Rotating Internal Structure Joint that Remains Flush with External Structure or Casing", the disclosure of which is incorporated by reference herein in its entirety.

BACKGROUND

Generally, railing systems include posts and a top rail, intended to provide a safety barrier and prevent falls from higher elevations, such as on decks, patios, landings, stairs, and any other locations where a person may fall from an elevated edge or structure. As railings are being installed, atop rail is installed over the posts and is typically horizontal along a deck, patio, or other landing, and is typically angled in descent or ascent on stairs. Installation of an angled top rail, such as for a railing system on stairs, is challenging even for an experienced installer, particularly with the positioning of support joints that need to be correctly angled for attachment of the top rail to the railing posts. Generally, the top of the railing posts and/or the support joints need to be custom measured and cut on the job site for the correct angle of a particular installation, adding to the complexity and challenges of installation, as well as extending the man-hours involved when installing railing systems with angled top rails. Furthermore, the type of conventional support joints used for railing system installations may be left exposed, leaving a negative cosmetic appearance. Even attempts to cover up the support joints with sleeves or other types of covers break-up the cosmetic appearance of post installations without clean lines, as well as requiring additional installation steps.

SUMMARY

This Summary introduces features and concepts of a rotatable structural bracket, which is further described below in the Detailed Description and shown in the Figures. This Summary should not be considered to describe essential features of the claimed subject matter, nor used to determine or limit the scope of the claimed subject matter.

Aspects of a rotatable structural bracket are described. In implementations, a rotatable structural bracket includes a top plate for placement in a horizontal rest position on an end of a structural section that has an internal void. The rotatable structural bracket also includes a rotatable extension for placement into the internal void of the structural section. The rotatable extension can be configured as a wedge that is rotatable out from the internal void to angle the top plate at any acute angle relative to the horizontal rest position of the top plate. The top plate and the rotatable extension are of single-piece construction, and the rotatable extension rotates relative to the structural section and internal of the structural section. The rotatable extension also encompasses an opening of the internal void at any acute angle.

In aspects, the structural section is an anchor post of a post assembly that is formed from the anchor post and the rotatable structural bracket. The rotatable extension of the rotatable structural bracket encompasses an opening of the internal void of the anchor post at any acute angle effective to maintain a one-piece appearance of the post assembly. The rotatable extension is an internal structural joint relative to the structural section, and the rotatable extension can be attached to the structural section at any acute angle. A curved segment of the rotatable extension is curved to rotate out from the internal void of the structural section, where the curved segment can be attached to the structural section at any acute angle. The curved segment of the rotatable extension can be attached to the structural section via anchors that are installable through the structural section into the curved segment of the rotatable extension.

In aspects of a rotatable structural bracket, the structural section may be an anchor post of a railing assembly, and the top plate can attach a top rail of the railing assembly to the anchor post. Similarly, the structural section may be an integrated component of a roof assembly, and the top plate can attach a support section of the roof assembly to the structural section. Notably, the rotatable structural bracket can be utilized as a framing connection in any number of building, construction, and/or roof assembly applications.

In other aspects, a railing assembly includes an anchor post that has an internal void. The railing assembly also includes a rotatable structural bracket that has a top plate formed with a rotatable extension for placement into the internal void of the anchor post. The rotatable extension is rotatable out from the internal void to angle the top plate at any acute angle relative to a horizontal plane that is perpendicular to the anchor post. The railing assembly also includes a top rail that attaches to the top plate at a slanted angle, where the top rail is positionable on the top plate at the slanted angle effective to automatically rotate the rotatable structural bracket and position the top plate at the acute angle.

BRIEF DESCRIPTION OF THE DRAWINGS

Implementations of a rotatable structural bracket are described with reference to the following Figures. The same numbers may be used throughout to reference similar features and components that are shown in the Figures.

DETAILED DESCRIPTION

Figure 1A:
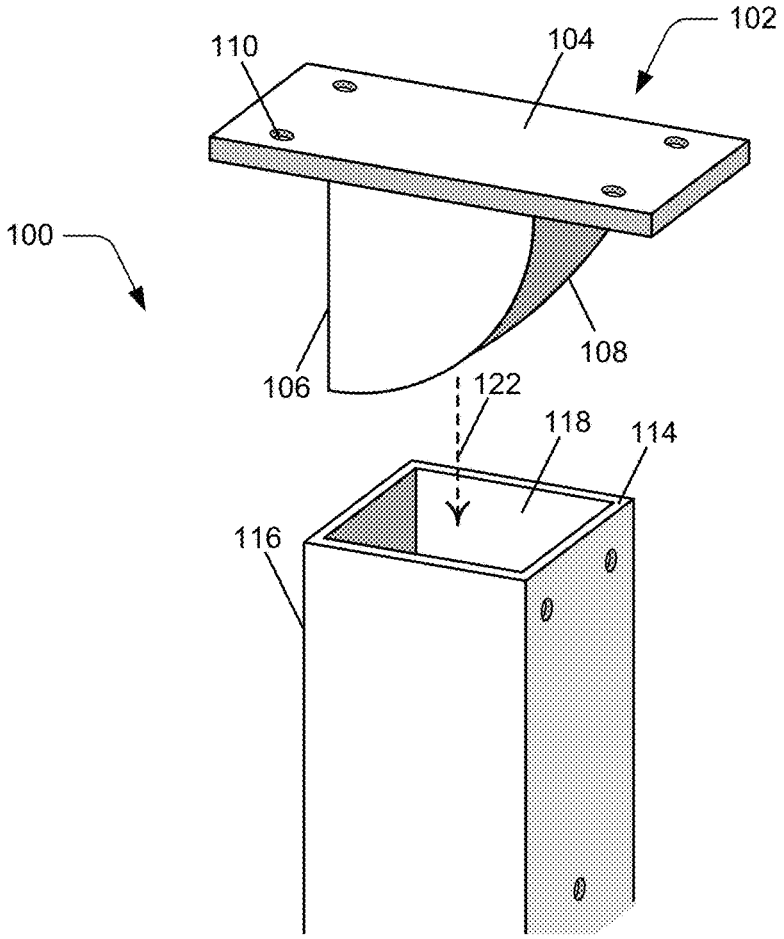
FIGS. 1A and 1B illustrate an example implementation of a rotatable structural bracket in accordance with aspects and features of the described bracket.

Implementations of a rotatable structural bracket are described, and provide a structural joint designed for quick and easy attachment of a top rail to anchor posts during installation of a railing system. Generally, railing systems include anchor posts and a top rail that is intended to provide a safety barrier and prevent falls from higher elevations, such as on decks, patios, landings, stairs, and any other locations where a person may fall from an elevated edge or structure. The top rail of a railing system can be installed over the anchor posts and is typically horizontal along a deck, patio, or other landing, and is typically angled in descent or ascent on stairs, adding to the complexity and challenges of installation. Notably, the features of a rotatable structural bracket as described herein provide a structural joint that does not require cutting or precise measuring on the job site to correctly angle the top rail so that the installation angle matches that of the stairs. Additionally, the rotatable structural bracket is designed both for use at any arbitrary angle, such as for the angled descent or ascent on stairs, as well as for the horizontal attachment of the top rail along a deck, patio, landing, or any other generally level area bordered by a railing system.

The rotatable structural bracket described herein includes a top plate and a rotatable extension, formed as a single-piece bracket, such as can be produced by 3D printing using ABS filament, injection molded with a two-part mold, formed from sheet metal, or any other type of applicable material. The top plate of the rotatable structural bracket is designed for placement in a horizontal rest position on an end of a structural section that has an internal void. For example, an anchor post is a structural section of a railing system, and the top plate rests over the opening in the top of the anchor post. The rotatable extension of the rotatable structural bracket is designed for placement into the internal void of the structural section, such as into the opening at the top of the anchor post. Generally in this configuration, the top plate in the horizontal rest position is approximately perpendicular to the anchor post and the rotatable extension is approximately parallel to the anchor post, as positioned in the internal void through the opening in the top of the anchor post.

In aspects of the rotatable structural bracket, the rotatable extension portion of the bracket is configured as a wedge shape (e.g., a 3D sector, pie-shape, quarter cylinder, or also referred to geometrically as a segment). The rotatable extension portion of the bracket is rotatable out from the internal void of the structural section to angle the top plate at any acute angle relative to the horizontal rest position of the top plate. Notably, the rotatable extension portion of the rotatable structural bracket rotates relative to the structural section and internal of the structural section (e.g., the anchor post). Given that the rotatable extension portion is integrated with the top plate as single-piece construction of the rotatable structural bracket, the rotation of the bracket also angles the top plate relative to the previous horizontal rest position of the top plate when placed over the opening in the top of the vertical structural section. With this technique, the top plate can be angled at any arbitrary angle between zero and ninety degrees (0°-90°) relative to the horizontal rest position of the top plate. From another point of view, the top plate is accordingly angled at any arbitrary angle between ninety and one-hundred eighty degrees (90°-180°) relative to the vertical plane of the structural section.

In aspects of the rotatable structural bracket, the rotatable extension portion of the bracket is designed to encompass the opening of the internal void of the structural section at any angle of the top plate. When the top plate of the rotatable structural bracket is placed over the opening in the top of an anchor post, for example, the opening is completely covered by the top plate and the rotatable extension portion extends below the top plate into the internal void of the anchor post. As the rotatable structural bracket is rotated, a portion of the rotatable extension is exposed between the top plate and the top of the anchor post at the opening to the internal void. However, the rotatable extension portion of the bracket still encompasses the internal opening by completely (or nearly completely) filling-in the opening of the internal void, remaining flush with the internal cross-section of the opening in the anchor post.

Notably, the rotatable extension portion of the bracket encompasses the opening of the internal void of the anchor post at any acute angle between zero and ninety degrees (0°-90°) effective to maintain a one-piece appearance of the post assembly. This provides the look of a clean cosmetic appearance of anchor post assemblies for railing systems. As an installer places the top rail on the top plates of respective rotatable structural brackets in several anchor posts that are spanned by the top rail, such as for installation of a railing system on stairs, the rotatable extension portion of the rotatable structural bracket rotates out of the anchor post (e.g., due to the top rail pressure) to align with the slanted angle of the top rail. The rotatable extension portion encompasses (e.g., completely or nearly completely fills-in) the opening of the anchor post cross-section as it rotates out of the internal void of the anchor post so that the post assembly still appears as a continuous piece with no gaps or exposed hardware. Thus, the top rail of the railing system can be installed at virtually any arbitrary angle to the post assembly.

In aspects of the rotatable structural bracket, the rotatable extension portion of the bracket is an internal structural joint relative to the structural section (e.g., an anchor post), and the rotatable extension can be attached to the structural section at any of the arbitrary acute angles during installation. A curved segment of the rotatable extension is curved to rotate out from the internal void of the structural section, where the curved segment can be attached to the structural section at any acute angle. The curved segment of the rotatable extension can be attached to the structural section via anchors that are installable through the structural section into the curved segment of the rotatable extension.

For example, the top rail of a railing system can be positioned for attachment to the top plate of the rotatable structural bracket at a slanted angle, where the top rail is positioned on the top plate at the slanted angle effective to automatically rotate the rotatable structural bracket and position the top plate of the bracket to meet the top rail at any angle. The top rail can be anchored to the top plate, such as with screws up through the bottom of the top plate and into the top rail. The rotatable structural bracket can then be anchored in place, such as with screws or pins that install through the side of the anchor post and into the rotatable extension portion of the rotatable structural bracket. Notably, the internal structural joint (e.g., the rotatable extension portion of the rotatable structural bracket) does not need to be anchored in a fixed position until after the top rail is attached to the top plate of the bracket.

The rotatable structural bracket is automatically rotated into place at the correct angle to match the slanted angle of the top rail, as corresponding to the angled descent or ascent of the stairs, and can be anchored in place after the top rail is attached to the top plate of the bracket. One can see that, for a section of the railing system with a long top rail spanning several anchor posts utilizing rotatable structural brackets, a single installer can easily move from one anchor post to the next, finalizing the installation at each post by anchoring the respective rotatable structural brackets at the positions in which they have been automatically rotated. This eliminates the need to custom measure and cut material on the job site for the correct angle of a particular installation, reducing or eliminating the complexity and challenges of installation, as well as minimizing the man-hours involved when installing railing systems with angled top rails. Furthermore, finished railing system installations will have a clean cosmetic appearance of the anchor post assemblies, without exposed hardware, anchors, or screws.

It should be noted that, although the rotatable structural bracket is generally described in the context of anchor post assemblies as related to railing system installations, the described aspects and techniques of a rotatable structural bracket can be utilized for many types of structures and assemblies, and used to create any arbitrary attachment between two structural members (one being hollow with an internal void). For example, a structural section may be positioned horizontally with the rotatable structural bracket used to attach another structural member at any arbitrary vertical angle. Further, a rotatable structural bracket can be used as an adjustable connection to create a roof to post connection for any type of structure that has a roof, such as a tent, a pergola, an awning, a covered porch attached to a house, a garage or shed, a recreational camping vehicle wall-to-roof joint, a building wall-to-roof joint, or any other type of similar structure. Notably, rotatable structural brackets can be used in construction as framing connections, such as for truss joints, roof construction, structural bridges, and the like. A builder can extend a structural section, such as a hollow steel post (or made from other rigid material) vertically up to approximately ceiling height, with the rotatable structural bracket positioned on the top of the post and then rotated to the required angle matching the pitch of the roof Thus, the design of the rotatable structural bracket allows for a post-to-pitched roof attachment for larger construction projects other than just a railing system installation. The rotatable structural bracket may also be used in manufacturing and for consumer products, such as in automobile frames, motorcycle frames, playground equipment and children's playsets, and other manufactured products.

In other aspects, an anchor post of a railing system can be implemented as a slotted anchor post with offset slotted holes on opposite sides of the anchor post. For example, a first side of the anchor post is designed with elongated, slotted holes, and a second side of the anchor post, opposite from the first side, can also have elongated, slotted holes. The slotted holes on both sides of the slotted anchor post are elongated in a vertical direction parallel with the anchor post, and the slotted holes are spaced apart down the two sides of the anchor post. Notably, the second-side slotted holes are offset in the vertical direction relative to the first-side slotted holes, so that if one were to look through a slotted hole from the first side of the anchor post, only a portion of the slotted hole on the first side would overlap a portion of a slotted hole on the second side of the anchor post. Accordingly, the first-side slotted holes have an overlapping offset relative to the second-side slotted holes, and the amount of overlapping offset is a design choice (e.g., ¼" overlap).

In implementations, such as for a cable railing system installation, the cabling can be routed through the corresponding slotted holes that partially overlap on the two sides of several of the slotted anchor posts to form a cable railing, such as from end post to end post and through several intermediate slotted anchor posts. The overlapping portion of the elongated, slotted holes provide that the cable railing can be run horizontally straight through the slotted holes from one anchor post to the next. Additionally, the overlapping offset feature of the elongated, slotted holes allow the cable railing to be run at any descent or ascent angle for a stairs installation, and the cable railing will match the slanted angle of the stairs, not to mention matching the installation angle of the top rail when attached to respective rotatable structural brackets in the slotted anchor posts. Although described in the context of a cable railing system, the slotted anchor posts may be designed with overlapping offset slotted holes for any type of wiring, cabling, or other system that utilizes a pass-through design structure.

While features and concepts of a rotatable structural bracket can be implemented in any number of different devices, assemblies, systems, environments, and/or configurations, implementations of a rotatable structural bracket are described in the context of the following example devices, assemblies, and methods.

Figure 1B:
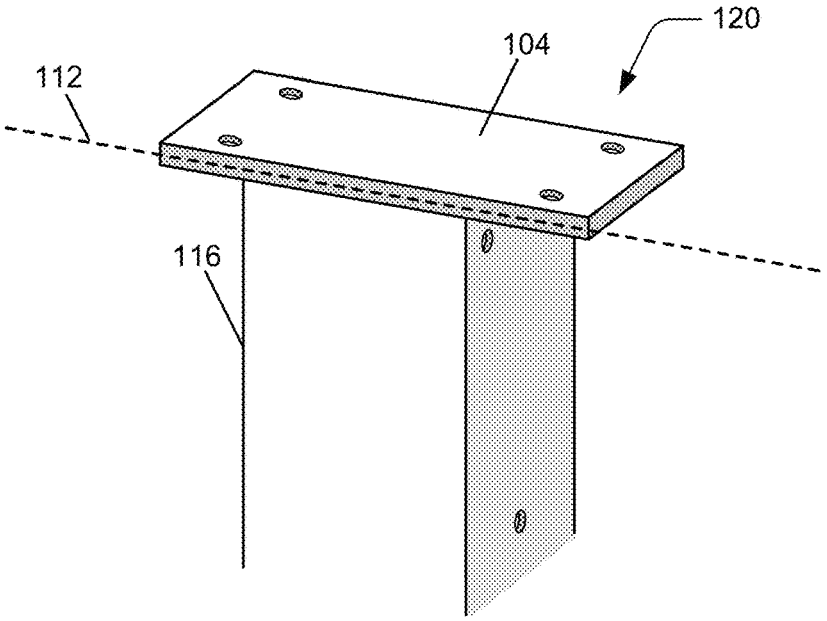

FIGS. 1A and 1B illustrate an example implementation 100 of a rotatable structural bracket 102 (FIG. 1A) in accordance with aspects and features of the described bracket. The rotatable structural bracket 102 includes a top plate 104 and a rotatable extension 106, formed as a single-piece bracket, such as can be produced by 3D printing using ABS filament, injection molded with a two-part mold, formed from sheet metal, or any other type of applicable material. The rotatable extension 106 of the rotatable structural bracket 102 has a rounded, curved segment 108, and generally, the rotatable extension portion of the bracket is configured as a wedge shape (e.g., a 3D sector, pie shape, quarter cylinder, or also referred to geometrically as a segment).

In this example, the top plate 104 of the rotatable structural bracket 102 has anchor points 110, illustrated as screw holes, through which screws, pins, or other types of anchors may be used to attach a structural component to the top plate 104 of the bracket. As generally described herein for a railing system installation, a top rail of the railing system can be attached to the top plate 104 of the rotatable structural bracket 102 via the anchor points 110, such as shown and described with reference to FIG. 2B.

The top plate 104 of the rotatable structural bracket 102 is designed for placement in a horizontal rest position 112 on an end 114 of a structural section 116 that has an internal void 118, such as shown at 120 (FIG. 1B). For example, an anchor post is a structural section of a railing system, and the top plate 104 rests over the opening in the top of the anchor post. The rotatable extension 106 of the rotatable structural bracket 102 is designed for placement into the internal void 118 of the structural section 116, such as into the opening at the top of an anchor post as generally shown at 122. Generally in the configuration shown at 120, the top plate 104 in the horizontal rest position 112 is approximately perpendicular to the structural section 116 and the rotatable extension 106 is approximately parallel to the structural section 116, as positioned in the internal void 118 through the opening in the top of the structural section.

Figure 2A:
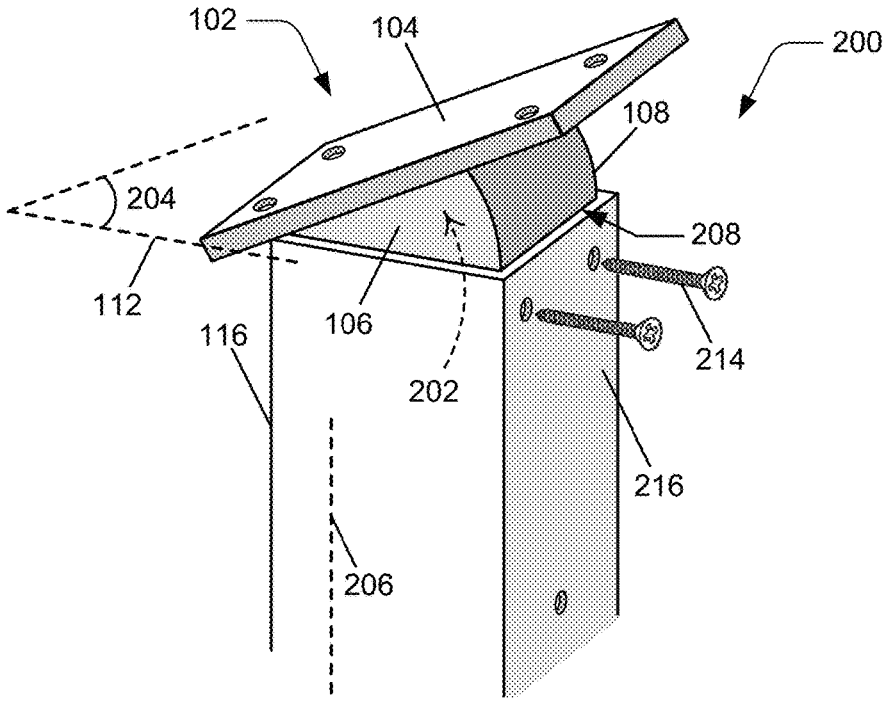
FIGS. 2A and 2B illustrate an example of a post assembly in which aspects and features of the rotatable structural bracket can be implemented.
Figure 2B:
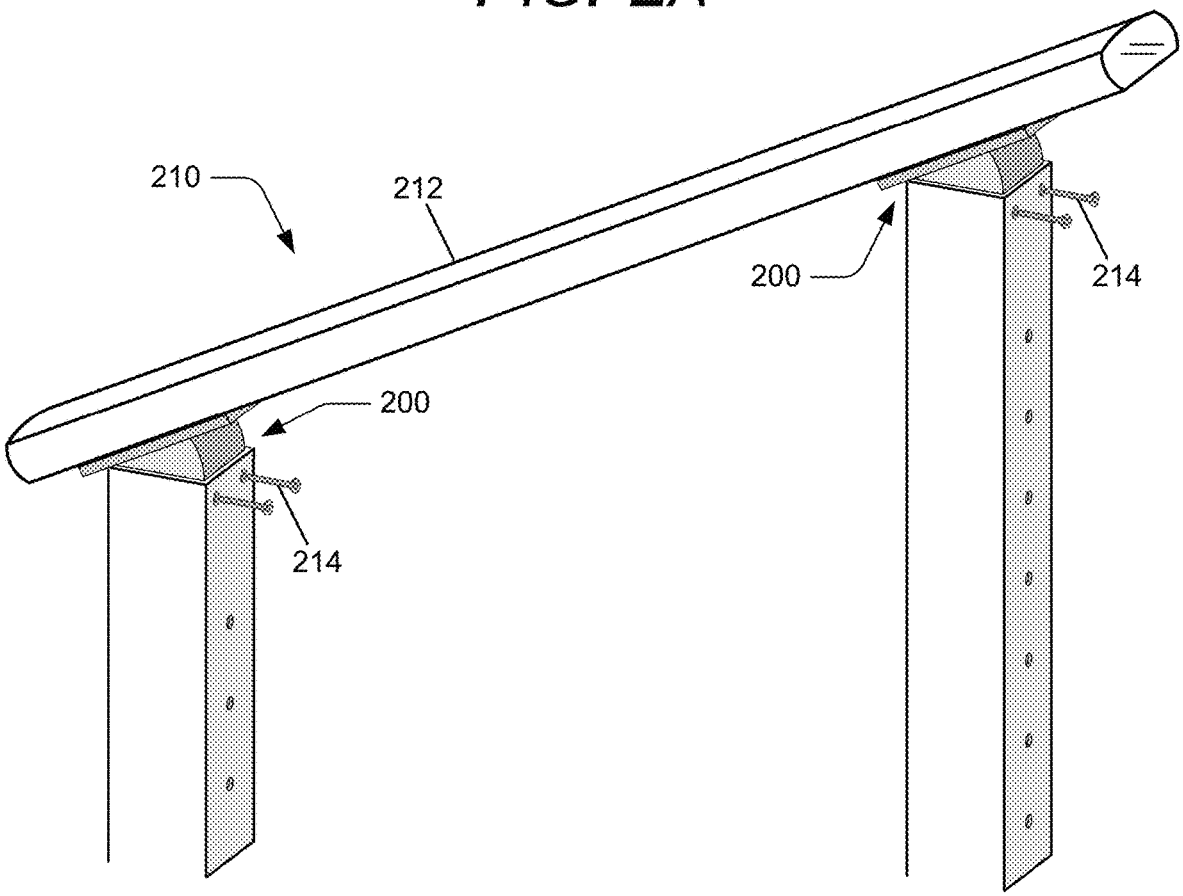

FIGS. 2A and 2B illustrate an example post assembly 200 in which aspects and features of the described rotatable structural bracket 102 can be implemented. As noted above, the rotatable extension 106 of the rotatable structural bracket 102 is designed for placement into the internal void of the structural section 116, such as into the opening at the top of an anchor post for a railing system installation. As shown in this example, the rotatable extension 106 of the rotatable structural bracket 102 is rotatable out from the internal void of the structural section 116, as generally shown at 202 (FIG. 2A). The rotation of the rotatable extension 106 out from the internal void of the structural section 116 is effective to angle the top plate 104 at any acute angle 204 relative to the horizontal rest position 112 of the top plate. Notably, the rotatable extension 106 of the rotatable structural bracket 102 rotates relative to the structural section 116 and internal of the structural section (e.g., the anchor post).

Given that the rotatable extension 106 is integrated with the top plate 104 as single-piece construction of the rotatable structural bracket 102, the rotation of the bracket also angles the top plate 104 relative to the previous horizontal rest position 112 of the top plate when last placed over the opening in the top of the vertical structural section. With this technique, the top plate 104 can be angled at any arbitrary angle 204 between zero and ninety degrees (0°-90°) relative to the horizontal rest position 112 of the top plate. From another point of view, the top plate 104 is accordingly angled at any arbitrary angle between ninety and one-hundred eighty degrees (90°-180°) relative to the vertical plane 206 of the structural section.

In aspects of the rotatable structural bracket 102, the rotatable extension 106 of the bracket is designed to encompass the opening of the internal void 118 of the structural section 116 at any angle 204 of the top plate 104. When the top plate 104 of the rotatable structural bracket 102 is placed over the opening in the top of an anchor post, for example, the opening is completely covered by the top plate 104 and the rotatable extension 106 extends below the top plate into the internal void 118 of the anchor post (e.g., as shown at 120 in FIG. 1B). As the rotatable structural bracket 102 is rotated, as generally shown at 202, a portion of the rotatable extension 106 is exposed between the top plate 104 and the top of the anchor post at the opening to the internal void. However, the exposed portion of the rotatable extension 106 of the bracket still encompasses the internal opening by completely (or nearly completely) filling-in the opening of the internal void, remaining flush with the internal cross-section of the opening in the anchor post, as generally shown at 208.

Notably, the rotatable extension 106 of the rotatable structural bracket 102 encompasses the opening of the internal void of the anchor post at any acute angle 204 between zero and ninety degrees)(0°-90°) effective to maintain a one piece appearance of the post assembly 200. This provides the look of a clean cosmetic appearance of anchor post assemblies for railing systems. As illustrated at 210 (FIG. 2B), a top rail 212 of a railing system can be placed on the top plates 104 of respective rotatable structural brackets 102 in several anchor posts (e.g., the post assemblies 200) that are spanned by the top rail, such as for installation of a railing system on stairs. The rotatable extension portion of the rotatable structural brackets rotates out of the anchor post (e.g., due to the top rail pressure) to align with the slanted angle of the top rail. The rotatable extension portion encompasses (e.g., completely or nearly completely fills-in) the opening of the anchor post cross-section as it rotates out of the internal void of the anchor post so that the post assembly 200 still appears as a continuous piece with no gaps or exposed hardware. Thus, the top rail 212 of the railing system can be installed at virtually any arbitrary angle to the post assembly.

In aspects of the rotatable structural bracket 102, the rotatable extension 106 of the bracket is an internal structural joint relative to the structural section 116 (e.g., an anchor post), and the rotatable extension 106 can be attached to the structural section at any of the arbitrary acute angles 204 during installation. The curved segment 108 of the rotatable extension 106 is curved to rotate out from the internal void 118 of the structural section 116, where the curved segment 108 can be attached to the structural section at any acute angle. The curved segment 108 of the rotatable extension 106 can be attached to the structural section 116 via anchors 214 (e.g., screws or pins) that are installable through the structural section 116 into the curved segment 108 of the rotatable extension 106, as generally shown at 216.

For example, the top rail 212 of a railing system can be positioned for attachment to the top plate 104 of the rotatable structural bracket 102 at a slanted angle, where the top rail 212 is positioned on the top plate 104 at the slanted angle effective to automatically rotate the rotatable structural bracket 102 and position the top plate of the bracket to meet the top rail at any angle. The top rail 212 can be anchored to the top plate 104, such as with screws up through the bottom of the top plate and into the top rail via the anchor points 110. The rotatable structural bracket 102 can then be anchored in place, such as with screws or pins that install through the side of an anchor post and into the rotatable extension 106 of the rotatable structural bracket. Notably, the internal structural joint (e.g., the rotatable extension portion of the rotatable structural bracket) does not need to be anchored in a fixed position until after the top rail 212 is attached to the top plate 104 of the bracket.

The rotatable structural bracket 102 is automatically rotated into place at the correct angle to match the slanted angle of the top rail 212, as corresponding to the angled descent or ascent of stairs in a railing system installation, and the rotatable structural bracket 102 can be anchored in place after the top rail is attached to the top plate of the bracket. One can see that, for a section of the railing system with a long top rail 212 spanning several anchor post assemblies 200 utilizing rotatable structural brackets, a single installer can easily move from one anchor post to the next, finalizing the installation at each post by anchoring the respective rotatable structural brackets at the positions in which they have been automatically rotated. This eliminates the need to custom measure and cut material on the job site for the correct angle of a particular installation, reducing or eliminating the complexity and challenges of installation, as well as minimizing the man-hours involved when installing railing systems with angled top rails. Furthermore, finished railing system installations will have a clean cosmetic appearance of the anchor post assemblies, without exposed hardware, anchors, or screws.

Figure 3:
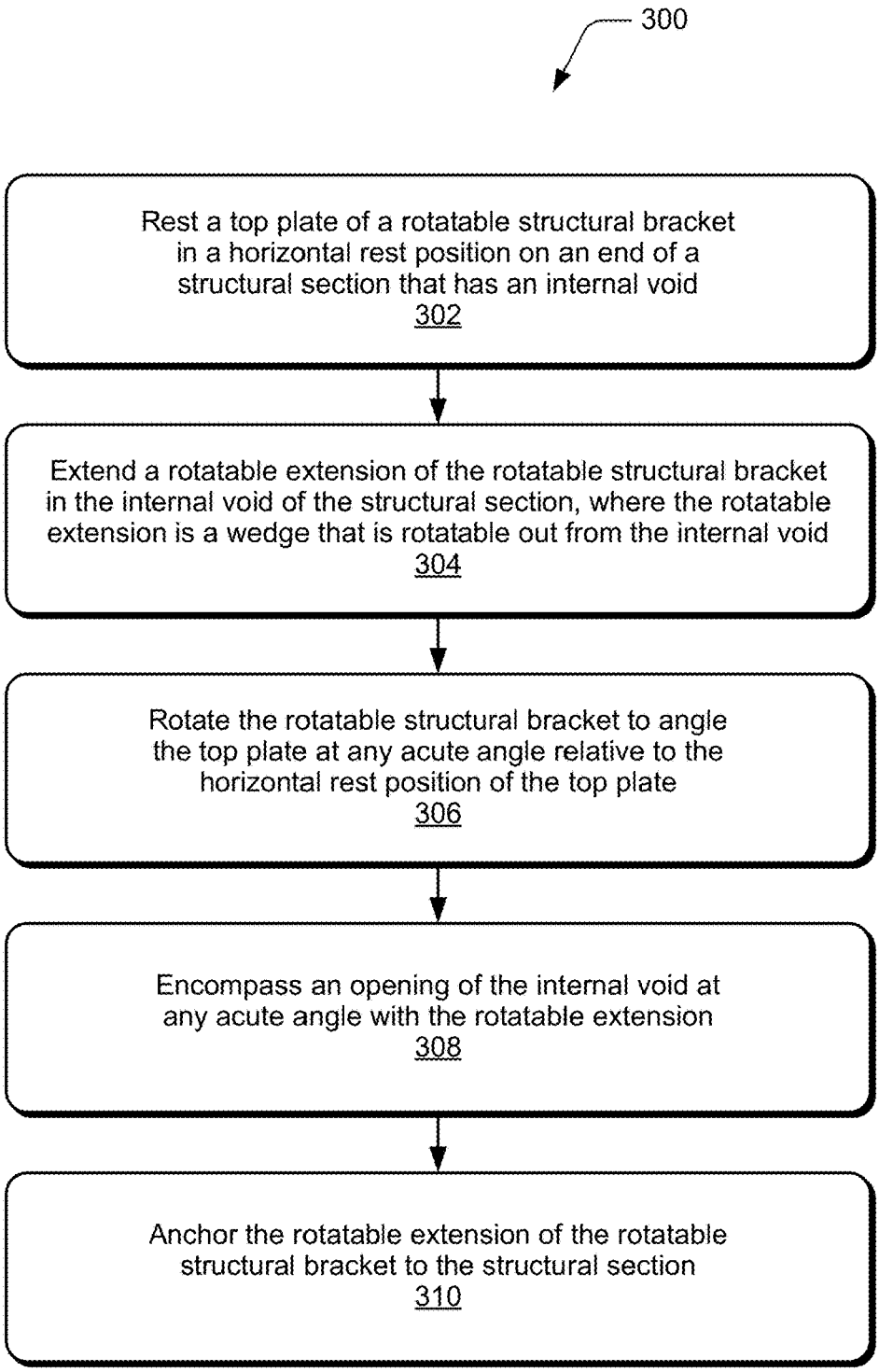
FIG. 3 illustrates an example method for a rotatable structural bracket in accordance with one or more implementations.

FIG. 3 illustrates example method(s) 300 for a rotatable structural bracket, and is generally described with reference to the rotatable structural bracket as shown and described with reference to FIGS. 1A, 1B and 2A 2B. The order in which the method is described is not intended to be construed as a limitation, and any number or combination of the method operations can be combined in any order to implement a method, or an alternate method.

At 302, a top plate of a rotatable structural bracket is rested in a horizontal rest position on an end of a structural section that has an internal void. For example, the rotatable structural bracket 102 includes the top plate 104 that is designed for placement in the horizontal rest position 112 on an end 114 of the structural section 116 that has an internal void 118. Notably, an anchor post is a structural section of a railing system, and the top plate 104 rests over the opening in the top of the anchor post. The rotatable extension 106 of the rotatable structural bracket 102 is designed for placement into the internal void 118 of the structural section 116, such as into the opening at the top of an anchor post as generally shown at 122 in FIG. 1A. Generally in the configuration shown at 120, the top plate 104 in the horizontal rest position 112 is approximately perpendicular to the structural section 116 and the rotatable extension 106 is approximately parallel to the structural section 116, as positioned in the internal void 118 through the opening in the top of the structural section.

At 304, a rotatable extension of the rotatable structural bracket is extended in the internal void of the structural section, where the rotatable extension is a wedge that is rotatable out from the internal void. For example, the rotatable structural bracket 102 includes the rotatable extension 106 that extends in the internal void 118 of the structural section 116, where the rotatable extension 106 is a wedge that is rotatable out from the internal void. Notably, the top plate 104 and the rotatable extension 106 are of single-piece construction forming the rotatable structural bracket 102. In implementations, the rotatable extension 106 is a pie-shaped wedge that rotates relative to the structural section 116 and internal of the structural section. The rotatable extension 106 of the rotatable structural bracket 102 has the rounded, curved segment 108, and generally, the rotatable extension portion of the bracket is configured as a wedge shape (e.g., a 3D sector, pie-shape, quarter cylinder, or also referred to geometrically as a segment).

At 306, the rotatable structural bracket is rotated to angle the top plate at any acute angle relative to the horizontal rest position of the top plate. For example, the rotatable structural bracket 102 rotates to angle the top plate 104 at any acute angle 204 relative to the horizontal rest position 112 of the top plate. Notably, the rotatable extension 106 of the rotatable structural bracket 102 rotates relative to the structural section 116 and internal of the structural section. Given that the rotatable extension 106 is integrated with the top plate 104 as single-piece construction of the rotatable structural bracket 102, the rotation of the bracket also angles the top plate 104 relative to the previous horizontal rest position 112 of the top plate when last placed over the opening in the top of the vertical structural section.

At 308, an opening of the internal void is encompassed at any acute angle with the rotatable extension. For example, the rotatable extension 106 of the rotatable structural bracket 102 encompasses the opening of the internal void 118 of the structural section 116 at any acute angle 204 of the top plate 104. When the top plate 104 of the rotatable structural bracket 102 is placed over the opening in the top of an anchor post, for example, the opening is completely covered by the top plate 104 and the rotatable extension 106 extends below the top plate into the internal void 118 of the anchor post (e.g., as shown at 120 in FIG. 1B). As the rotatable structural bracket 102 is rotated (e.g., as generally shown at 202 in FIG. 2A), a portion of the rotatable extension 106 is exposed between the top plate 104 and the top of the anchor post at the opening to the internal void. However, the exposed portion of the rotatable extension 106 of the bracket still encompasses the internal opening by completely (or nearly completely) filling-in the opening of the internal void, remaining flush with the internal cross-section of the opening in the anchor post (e.g., as generally shown at 208 in FIG. 2A). In implementations, the rotatable extension 106 encompasses the opening of the internal void 118 at any acute angle 204 effective to maintain a one-piece appearance of the post assembly 200.

At 310, the rotatable extension of the rotatable structural bracket is anchored to the structural section. For example, the rotatable extension 106 of the rotatable structural bracket 102 is anchored to the structural section 116. The rotatable extension 106 is an internal structural joint relative to the structural section 116, and the rotatable extension 106 is designed for attachment to the structural section at any acute angle 204. The curved segment 108 of the rotatable extension 106 is curved to rotate out from the internal void 118 of the structural section 116, where the curved segment 108 is designed for attachment to the structural section at any acute angle 204. For example, the curved segment 108 of the rotatable extension 106 is designed for attachment to the structural section 116 via the anchors 214 (e.g., screws or pins) that are installable through the structural section into the curved segment of the rotatable extension.

Figure 4A:
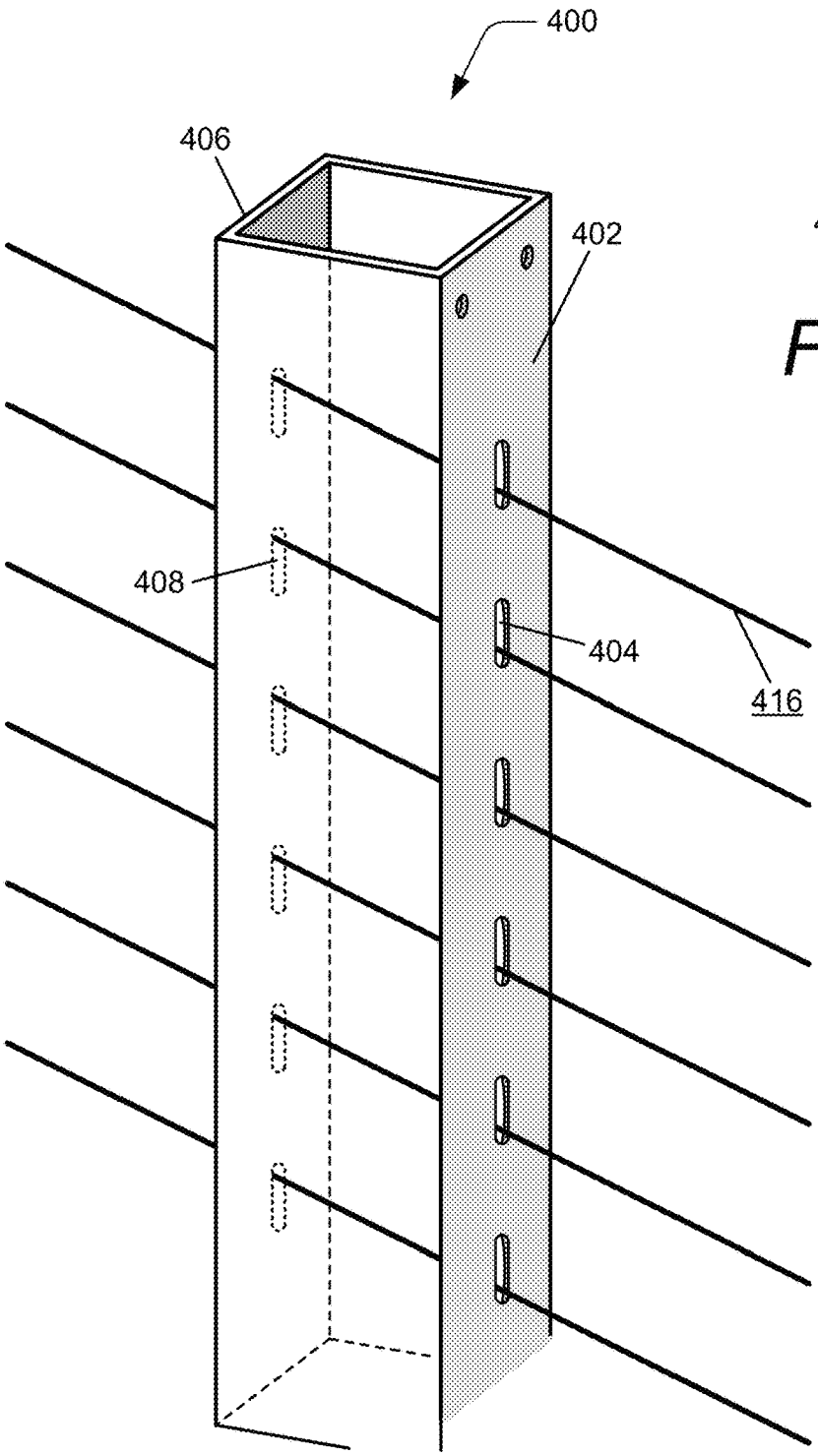
FIGS. 4A and 4B illustrate an example of a slotted anchor post in which aspects and features of the described rotatable structural bracket can be implemented, particularly in conjunction with a cable railing system.
Figure 4B:
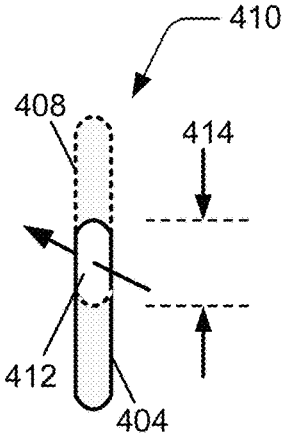

FIGS. 4A and 4B illustrate an example slotted anchor post 400 in which aspects and features of the described rotatable structural bracket 102 can be implemented, particularly in conjunction with a cable railing system that utilizes slotted anchor posts for convenient installation at any arbitrary angle, such as for the angled descent or ascent on stairs. The slotted anchor post 400 (FIG. 4A) is designed with offset slotted holes on opposite sides of the anchor post. For example, a first side 402 of the slotted anchor post 400 is designed with elongated, slotted holes 404, and a second side 406 of the anchor post, opposite from the first side 402, also has elongated, slotted holes 408. The slotted holes 404, 408 on both sides of the slotted anchor post 400 are elongated in a vertical direction parallel with the anchor post, and the slotted holes are spaced apart down the two sides of the anchor post. Additionally, the elongated, slotted holes may be lined with a gromet or other material to prevent the cabling from shifting or vibrating.

Notably, the second-side slotted holes 408 are offset in the vertical direction relative to the first-side slotted holes 404, so that if one were to look through a slotted hole 404 from the first side 402 of the anchor post, as generally shown at 410 (FIG. 4B), only a portion 412 of the slotted hole 404 on the first side 402 would overlap a portion of the slotted hole 408 on the second side 406 of the anchor post. Accordingly, the first-side slotted holes 404 have an overlapping offset 414 relative to the second-side slotted holes 408, and the amount of the overlapping offset 414 is a design choice (e.g., ¼" overlap).

In implementations, such as for a cable railing system installation, the cabling can be routed through the corresponding slotted holes 404, 408 that partially overlap on the two sides 402, 406 of several of the slotted anchor posts 400 to form a cable railing 416, such as from end post to end post and through several intermediate slotted anchor posts. The overlapping portion 412 of the elongated, slotted holes provide that the cable railing 416 can be run horizontally straight through the slotted holes from one anchor post to the next. Additionally, the overlapping offset feature of the elongated, slotted holes 404, 408 allow the cable railing 416 to be run at any descent or ascent angle for a cable railing stairs installation, and the cable railing will match the slanted angle of the stairs, not to mention matching the installation angle of the top rail 212 when attached to respective rotatable structural brackets 102 in the slotted anchor posts 400. Although described in the context of a cable railing system, the slotted anchor post 400 may be designed with overlapping offset slotted holes for any type of wiring, cabling, or other system that utilizes a pass-through design structure.

Figure 5C:
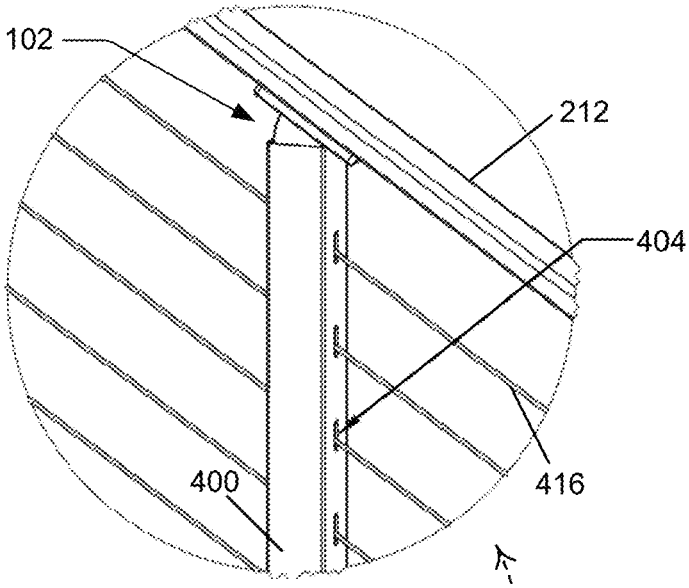
FIGS. 5A, 5B, and 5C illustrate example detail views of a cable railing system installation that utilizes slotted anchor posts in conjunction with rotatable structural brackets in accordance with one or more implementations.
Figure 5A:
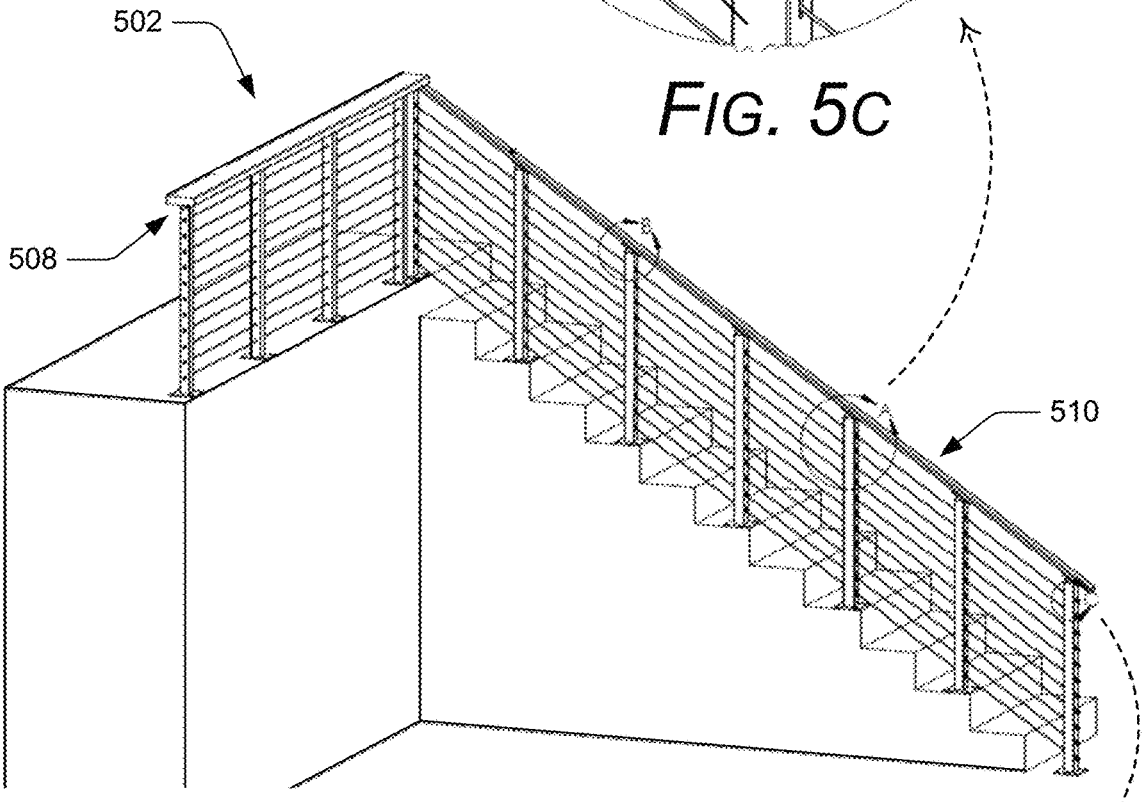
Figure 5B:
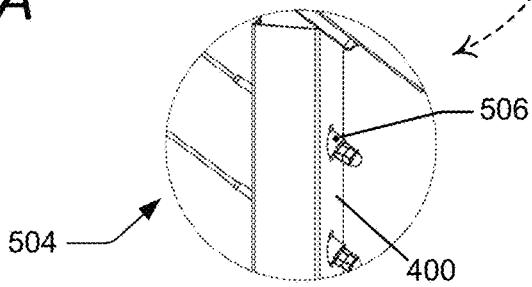

FIGS. 5A, 5B, and 5C illustrate example detail views 500 of a cable railing system installation 502 (FIG. 5A) that utilizes slotted anchor posts 400 in conjunction with rotatable structural brackets 102 that attach the top rail 212 to the top plate 104 of the brackets, and to the slotted anchor posts, as generally shown and described with reference to FIGS. 1A-4B. Additionally, a detail view 504 (FIG. 5B) illustrates use of bevel washer hardware 506 that is implemented to match the angle of the cable railing with the slanted angle of the stairs, and without additional fabrication by an installer of the system.

As generally noted above, the cable railing system installation 502 includes the slotted anchor posts 400 and the top rail 212 (FIG. 5C) that is intended to provide a safety barrier and prevent falls from higher elevations, such as on decks, patios, landings, stairs, and any other locations where a person may fall from an elevated edge or structure. The top rail 212 of the cable railing system can be installed over the anchor posts and is typically horizontal along a deck, patio, or other landing, as generally shown at 508, and is typically angled in descent or ascent on stairs, as generally shown at 510. Notably, the features of a rotatable structural bracket 102 as described herein provide a structural joint that does not require cutting or precise measuring on the job site to correctly angle the top rail 212 so that the installation angle matches the slanted angle of the stairs. Additionally, the rotatable structural bracket 102 is designed both for use at any arbitrary angle, such as for the angled descent or ascent on the stairs at 510, as well as for the horizontal attachment of the top rail along a deck, patio, landing, or any other generally level area bordered by a railing system at 508.

Although implementations of a rotatable structural bracket have been described in language specific to features and/or methods, the appended claims are not necessarily limited to the specific features or methods described. Rather, the specific features and methods are disclosed as example implementations of a rotatable structural bracket, and other equivalent features and methods are intended to be within the scope of the appended claims. Further, various different examples are described and it is to be appreciated that each described example can be implemented independently or in connection with one or more other described examples.

The invention claimed is:

1. A rotatable structural bracket assembly, comprising:

a vertical anchor post with an internal void that opens at a top end of the vertical anchor post of a railing assembly; and a rotatable structural bracket comprising a top plate and a rotatable extension, the top plate covering the internal void in a horizontal rest position on the top end of the vertical anchor post, and the rotatable extension configured parallel in the internal void at the top end of the vertical anchor post, the rotatable extension configured as a wedge that is rotatable out from the internal void of the vertical anchor post to angle the top plate of the rotatable structural bracket at any acute angle relative to the horizontal rest position of the top plate.

2. The rotatable structural bracket assembly as recited in claim 1, wherein the top plate and the rotatable extension are of single-piece construction.

3. The rotatable structural bracket assembly as recited in claim 1, wherein the rotatable extension is a pie-shaped wedge configured to rotate relative to the internal void of the vertical anchor post.

4. The rotatable structural bracket assembly as recited in claim 1, wherein the rotatable extension of the rotatable structural bracket encompasses an opening of the internal void in the top end of the vertical anchor post at the any acute angle.

5. The rotatable structural bracket assembly as recited in claim 1, wherein the rotatable extension of the rotatable structural bracket encompasses an opening of the internal void in the top end of the vertical anchor post at the any acute angle effective to maintain a one-piece appearance of the post assembly comprising the rotatable structural bracket assembly.

6. The rotatable structural bracket assembly as recited in claim 1, wherein the rotatable extension of the rotatable structural bracket is an internal structural joint relative to the vertical anchor post, the rotatable extension configured for attachment to the vertical anchor post at the any acute angle.

7. The rotatable structural bracket assembly as recited in claim 1, wherein a curved segment of the rotatable extension of the rotatable structural bracket is curved to rotate out from the internal void in the top end of the vertical anchor post, the curved segment of the rotatable extension configured for attachment to the vertical anchor post at the any acute angle.

8. The rotatable structural bracket assembly as recited in claim 1, wherein a curved segment of the rotatable extension is configured for attachment to the vertical anchor post via anchors that are installable through the vertical anchor post into the curved segment of the rotatable extension.

9. The rotatable structural bracket assembly as recited in claim 1, wherein the top plate of the rotatable structural bracket is configured to attach a top rail of the railing assembly.

10. The rotatable structural bracket assembly as recited in claim 1, wherein the top plate of the rotatable structural bracket is configured to attach a support section of the railing assembly.

11. A method for a rotatable structural bracket assembly, the method comprising:

resting a top plate of a rotatable structural bracket in a horizontal rest position, the top plate covering an internal void that opens at a top end of a vertical anchor post of a railing assembly;

extending a rotatable extension of the rotatable structural bracket parallel in the internal void at the top end of the vertical anchor post, the rotatable extension configured as a wedge that is rotatable out from the internal void of the vertical anchor post; and rotating the rotatable structural bracket to angle the top plate of the rotatable structural bracket at any acute angle relative to the horizontal rest position of the top plate.

12. The method as recited in claim 11, further comprising encompassing an opening of the internal void at the any acute angle with the rotatable extension.

13. The method as recited in claim 11, further comprising anchoring the rotatable extension of the rotatable structural bracket to the vertical anchor post.

14. The method as recited in claim 11, wherein the rotating the rotatable structural bracket comprises rotating the rotatable extension relative to the internal void of the vertical anchor post.

15. A railing assembly, comprising:

a vertical anchor post with an internal void that opens at a top end of the vertical anchor post;

a rotatable structural bracket comprising a top plate formed with a rotatable extension configured parallel in the internal void at the top end of the vertical anchor post with the top plate perpendicular to the vertical anchor post covering the internal void, the rotatable extension being rotatable out from the internal void of the vertical anchor post to angle the top plate at any acute angle relative to a horizontal plane that is perpendicular to the vertical anchor post; and a top rail configured for attachment to the top plate at a slanted angle, the top rail positionable on the top plate at the slanted angle effective to automatically rotate the rotatable structural bracket and position the top plate at the any acute angle.

16. The railing assembly as recited in claim 15, wherein the top plate and the rotatable extension of the rotatable structural bracket are of single-piece construction.

17. The railing assembly as recited in claim 15, wherein the rotatable extension of the rotatable structural bracket encompasses an opening of the internal void at the any acute angle.

18. The railing assembly as recited in claim 15, wherein the rotatable extension of the rotatable structural bracket encompasses an opening of the internal void at the any acute angle effective to maintain a one-piece appearance of a post assembly comprising the vertical anchor post and the rotatable structural bracket.

19. The railing assembly as recited in claim 15, wherein a curved segment of the rotatable extension of the rotatable structural bracket is curved to rotate out from the internal void of the vertical anchor post, the curved segment configured for attachment to the vertical anchor post at the any acute angle.

20. The railing assembly as recited in claim 15, wherein a curved segment of the rotatable extension of the rotatable structural bracket is configured for attachment to the vertical anchor post via one or more anchors that are installable through the vertical anchor post into the curved segment of the rotatable extension.

* * * * *